US005967451A

United States Patent [19]

Radaios

[11] Patent Number: 5,967,451

[45] Date of Patent: Oct. 19, 1999

[54] CABLE WIRE SPOOL

[76] Inventor: Hristos Radaios, 798 S. Westgate St., Des Plaines, Ill. 60016

[21] Appl. No.: 09/118,439

[22] Filed: Jul. 17, 1998

[51] Int. Cl.[6] ..... B65H 49/32; B65H 59/04

[52] U.S. Cl. ..... 242/594.2; 242/422.4; 242/595

[58] Field of Search ..... 242/422.4, 594.2, 242/594.1, 594.3, 594.4, 595, 598.3, 598.6, 588.2, 588.3, 588.6, 129, 129.6, 129.62, 129.5, 129.8, 132, 137, 137.1, 138, 146; 206/394, 407, 408, 409

[56] References Cited

U.S. PATENT DOCUMENTS

| | | | |
|---|---|---|---|
| 30,725 | 11/1860 | Estes | 242/129.6 |
| D. 253,022 | 10/1979 | Sligh . | |
| D. 304,534 | 11/1989 | Gustafson . | |
| 2,462,776 | 2/1949 | Price | 242/598.6 |
| 2,487,763 | 11/1949 | Patterson et al. | 242/598.6 |
| 2,715,458 | 8/1955 | Polglase . | |
| 3,948,455 | 4/1976 | Schwartz . | |
| 4,006,854 | 2/1977 | Gibson et al. . | |
| 4,083,268 | 4/1978 | Kober . | |
| 4,475,694 | 10/1984 | Reece | 242/594.3 |
| 5,152,395 | 10/1992 | Cross . | |
| 5,263,658 | 11/1993 | Baucom et al. | 242/129.62 |
| 5,330,120 | 7/1994 | Tussing . | |
| 5,495,653 | 3/1996 | Schrock et al. . | |
| 5,551,647 | 9/1996 | Browning . | |
| 5,634,610 | 6/1997 | Walsh . | |
| 5,687,928 | 11/1997 | Lassiter | 242/594.1 |
| 5,881,967 | 3/1999 | Dawson et al. | 242/129 |

OTHER PUBLICATIONS

Publication Relating to Ideal Portable Wire Spool Holder.

*Primary Examiner*—John M. Jillions
*Attorney, Agent, or Firm*—Wallenstein & Wagner, Ltd.

[57] ABSTRACT

The invention is a carrier of one or more wire spools. The carrier is portable, and is suitable for the separate or simultaneous dispensing of wire from one or more wire spools housed within the carrier. The carrier includes a central rod through which the wire spools are inserted. This cross-section of this central rod may be hollow or solid. The carrier further includes a generally semi-circular cradle positioned below the wire spools. A pair of end walls supports this semi-circular cradle. Channels in the end walls permit rotation of the cradle relative to these end walls. The channels are formed by a generally circular cut-out in each of the end walls. The carrier also includes one or more slots in the cradle for the passage and dispensing of that wire through these slots.

11 Claims, 3 Drawing Sheets

CABLE WIRE SPOOL

TECHNICAL FIELD

This invention relates to a wire dispenser for holding and dispensing one or more spools of electrical wire, or television or computer cable. The wire dispenser of the invention is particularly suitable for use at construction sites.

BACKGROUND OF THE INVENTION

Wire or cable dispensers are well-known in the art. These wire or cable dispensers may or may not be portable, may carry one or more spools of wire or cable, and may be comprised of stationary parts or a combination of stationary and moving parts.

One such cable or wire dispenser is described and claimed in U.S. Pat. No. 5,634,610, issued to Walsh on Jun. 3, 1997. Walsh discloses and claims a portable wire dispenser for holding and dispensing one or more spools of electrical wire or television or computer cable. Walsh permits replacement of exhausted wire spools without disturbing remaining non-exhausted wire spools, and also prevents free spinning of wire spools as wire is dispensed. Walsh does this by means of a fixed support member (item 50 in FIG. 1 of Walsh) and by means of a rotatable member (60) positioned above the spools.

Other cable or wire dispensers are shown in U.S. Pat. Nos. 2,715,458, issued to Polglase on Aug. 16, 1955; U.S. Pat. No. 3,948,455, issued to Schwartz on Apr. 6, 1976; U.S. Pat. No. 4,006,854, issued to Gibson et al. on Feb. 8, 1977; U.S. Pat. No. 4,083,268, issued to Kober on Apr. 11, 1978; U.S. Pat. No. 5,152,395, issued to Cross on Oct. 6, 1992; U.S. Pat. No. 5,330,120, issued to Tussing on Jul. 19, 1994; U.S. Pat. No. 5,495,653, issued to Schrock et al. on Mar. 5, 1996; U.S. Pat. No. 5,551,647, issued to Browning on Sep. 3, 1996; Des. U.S. Pat. No. 253,022, issued to Sligh on Oct. 2, 1979; and U.S. Pat. No. Des. 304,534, issued to Gustafson on Nov. 14, 1989.

SUMMARY OF THE INVENTION

The invention is a carrier of one or more wire spools. The carrier is portable, and is suitable for the separate or simultaneous dispensing of wire from the wire spools held by the carrier. The carrier includes a central rod through which the wire spools are inserted. The cross-section of this central rod may be hollow or solid.

The carrier further includes a generally semi-circular cradle positioned below the wire spools. A pair of end walls supports this semi-circular cradle. Channels in the end walls permit rotation of the cradle relative to these end walls. Preferably, the channels are formed by a generally C-shaped or circular cut-out in each of the end walls.

Preferably, the carrier also includes one or more slots in the cradle for the passage and dispensing of that wire through these slots.

The carrier also preferably includes an orifice in each of the end walls for the support of the central rod. The orifice in the end wall is preferably of a non-circular configuration, and is most preferably of a generally oval configuration.

Accordingly, the carrier of the invention provides a portable means of dispensing one or more strands of wire from one or more cable spools. The invention also provides a simplified structure for dispensing wire, and preventing uncontrolled feeding of wires as a result of free spinning of the wire spools. The present carrier also prevents the tangling or kinking of wire or cable as it is being dispensed.

DETAILED DESCRIPTION OF THE PREFERRED EMBODIMENT

Figure 1:
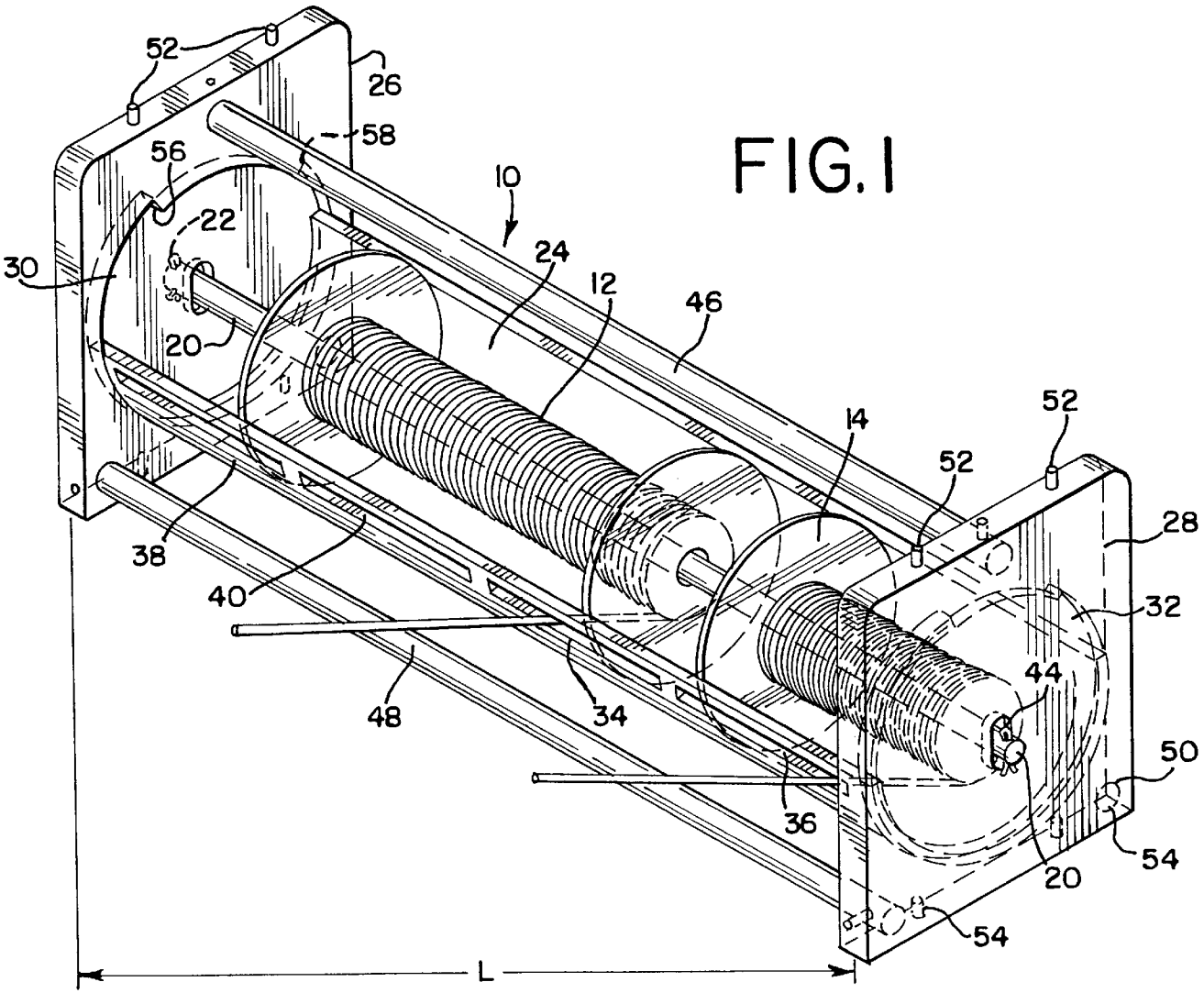
FIG. 1 is a perspective view of a preferred embodiment of a wire spool carrier in accordance with the invention, with the cradle of the carrier in a lower rest position, and with a wire strand extending outwardly from each of the two spools shown.

While this invention is susceptible of embodiment in many different forms, the present specification describes in detail a preferred embodiment of the invention. This disclosure is merely to be considered as an exemplification of the principles of the invention. This disclosure is not intended to limit the broad aspect of the invention to the illustrated embodiments.

One preferred embodiment of the present invention is shown in FIGS. 1–4. The invention is a carrier 10 of one or more wire spools. Although it should be understood that any number of spools may be used in connection with the invention, this embodiment includes two spools, shown in FIG. 1 as items 12 and 14.

At least two more spools (not shown) could be added to the carrier depicted in FIGS. 1–4. Such a four-spool embodiment may be particularly appropriate, for example, for use at commercial electrical installations, which frequently require the simultaneous installation of three "hot" wires and one "neutral" wire. This carrier 10, which is portable, is completely suitable for either such simultaneous dispensing of two or more wires, or of the dispensing of only one wire strand from the wire spools 12, 14, contained upon the carrier 10. This four-spool embodiment will have an approximate length L of approximately twenty-four (24) inches.

The carrier 10 includes a central rod 20 through which each of the wire spools 12, 14, are inserted. The interior of this central rod 20 may be either hollow or solid. A solid central rod will include a bore for insertion, at each opposite lateral end of that rod 20, of a cotter pin 22 or similar fastening means. In contrast, a hollow central rod 20 will not include a bore, but will instead include two holes, offset by 180 degrees, along the surface of that rod. A solid rod is somewhat preferable to a hollow rod, in that it is easier to insert the cotter pin 22 through the bore of a solid rod than to insert that cotter pin through a pair of 180 degree-offset holes.

The carrier 10 further includes a cradle, and most preferably a generally semi-circular cradle 24. This cradle 24 is positioned below the wire spools 12, 14. This semi-cylindrical or semi-circular cradle 24 has a number of functions, each of which will be explained in more detail below. However, as an overview, this cradle first supports the wire spools 12, 14, when they are at rest, as may best be seen in FIGS. 1 and 3. Second, this cradle serves to protect the wire spools from the phenomenon of "free wheeling", in which the spools continue to spin after the user has ceased pulling wire from those spools. This "free-wheeling" phenomenon results in the dispensing of excess wire, and in the inconvenient and time-consuming need to rewind that wire back onto its spool. Particularly, the carrier 10 is constructed so that as soon as the user stops pulling on the wire or cable, the cradle 24 returns, by gravity, to its lower rest position of FIGS. 1 and 3, the spools fall back onto the cradle 24, and the resulting increased friction between the now fully-engaged peripheral edges of the wire spools and the cradle 24 immediately inhibits the rotation of the wire spools. Third, the cradle 24 includes one or more slots through which the wire is dispensed. Combined with the movability of the cradle 24, these slots permit dispensing of the wire from the carrier 10 with no kinking of that wire. Fourth, the carrier is constructed so that the wire spools 12, 14, may move somewhat away from the cradle 24 when wire is being dispensed. As a result, there is less friction between the peripheral edges of the wire spools and the adjacent cradle 24. This decrease in friction facilitates easier rotation of the spools when the wire is being dispensed.

A pair of end walls 26 and 28 supports this semi-circular cradle 24. Some sort of supporting structure in the end walls 26 and 28 is necessary to permit rotation of the cradle 24 relative to the end walls 26 and 28. This supporting structure could be a pair of appropriately configured channels in the end walls 26 and 28. In the present embodiment, however, as can best be seen in FIGS. 1, 3, and 4, these channels 30 and 32 are a C-shaped element formed along a portion of each of the end walls 26 and 28. The opposite lateral ends of the cradle 24 rotate about and are guided by these C-shaped elements 30 and 32.

Preferably, there are one or more slots in the cradle 24. These slots facilitate the passage and dispensing of wire or cable from the spools. In the most preferred embodiment of FIGS. 1–4, four slots 34, 36, 38, and 40 are included, one slot for each of spools four spools, including spools 12 and 14, and two spools not shown in the drawings. As may be seen in FIG. 1, these slots are all positioned on one side of the cradle 24.

Figure 2:
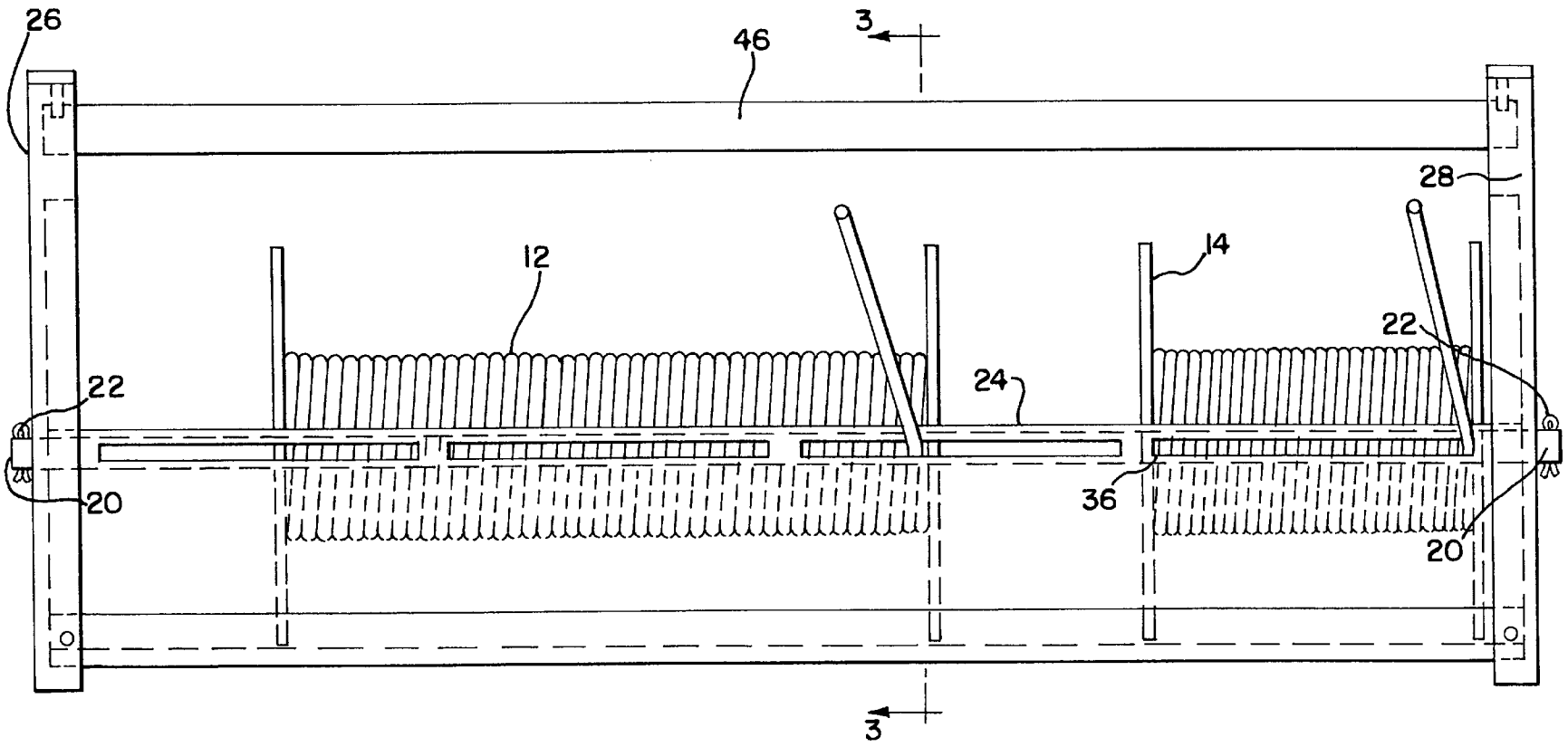
FIG. 2 is a side view of the wire spool carrier of FIG. 1.

Wire is wound onto spools along the entire length of the spools, so that the height of wire along the length of the spool is somewhat uniform. Accordingly, as wire is unwound from these spools, the discharge point of the wire varies along the length of the spool. In particular, the wire is first discharged from one end of the spool, is then discharged from the middle of the spool, is next discharged from the other end of the spool, is then discharged from the middle of the spool, and so on. To facilitate these varying discharge points, it is preferred that these slots 34, 36, 38, and 40 will have a length roughly corresponding to the length of their adjacent wire spool. In this way, as the wire is unwound from the spools, the wire will be able to be discharged through, and at various points along the length of, those slots. This is best shown in FIG. 2 by the relationship of spool 14 to slot 36.

The carrier 10 also preferably includes an orifice 42 and 44 in each of the end walls 26 and 28 for the support of, and for permitting the vertical movement of, the central rod 20. The orifices 42 and 44 in the end walls 26 and 28 are preferably of a non-circular configuration, and are most preferably of a generally oval configuration. In this way, as may be seen in FIGS. 1 and 3, the central rod 20 abuts against the lower perimeter of the orifices 42 and 44 when wire is not being discharged from the spools. In contrast, as may be seen in FIG. 4, while wire is being discharged from the spools, the central rod 20 can move slightly above the lower end of orifices 42 and 44. The shape of the orifices permits not only vertical movement of the central rod, but facilitates movement of the spools 12 and 14 away from the cradle 24.

The carrier 10 is provided with a handle 46 near the top of the ends walls 26 and 28. This handle 46 is stationary, and is spaced away from and does not contact the wire spools positioned upon the carrier 10. In fact, the handle 46 is spaced sufficiently away from the wire spools 12, 14, 16, and 18 so that even when those spools are full of wire, one can grip the handle 46 and comfortably transport the carrier 10. The handle 46 may be secured to the end walls 26 and 28 by self-locking screws, as shown in FIGS. 1–4. There, the handle 46 is inserted into a cavity in the end walls 26 and 28, and secured to each of the end walls with such a self-locking screw or other similar fastener. As may be seen in FIGS. 1–4, this screw may be vertically oriented, i.e., it may be secured to the handle through an orifice extending vertically down from the top of the end walls 26 and 28.

Connecting the base of the end walls 26 and 28 are a pair of rods 48 and 50 or other similar stabilizing means. Each of these rods 48 and 50 is secured to the end walls 26 and 28 with self-locking screws, in generally the same manner as the handle 46 is secured to the end walls, and as described in the immediately preceding paragraph.

To fully understand the advantages of the present invention, the operation of the carrier 10 shall be explained. The carrier 10 has two positions: a rest position, in which wire is not being dispensed, and a dispensing position, in which the wire is being fed from the carrier. In its rest position, as shown in FIG. 1, the rod 20 rests against the bottom of the orifices 42 and 44. In this position, the wire spools 12, 14, are fully supported by the semi-circular cradle 24.

Figure 4:
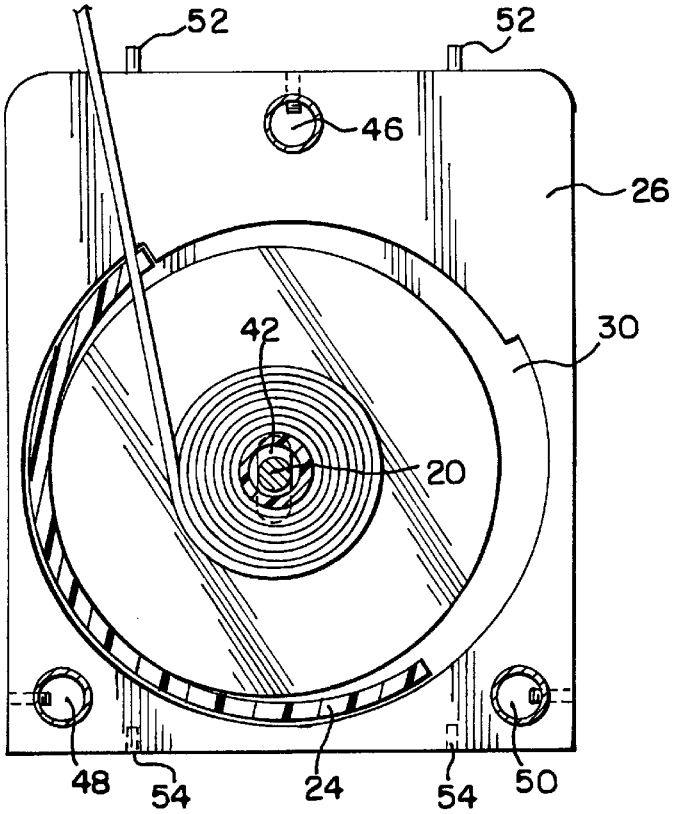
FIG. 4 is an inner end view of one of the ends walls of the wire spool carrier of the invention, taken along lines 3—3 of FIG. 2, but with the wire spool in a dispensing position.

The second of the two positions, i.e., the dispensing position, is shown in FIG. 4. In this position, wire is being dispensed from the carrier 10. As the user pulls wire from the cable spools 12, for example, the wire contacts and biases the cradle 24 at a spot near the upper end of the slot 34. The resulting force from the wire upon the slot 34 biases and causes rotation of the cradle 24 relative to the end walls 26 and 28, and causes some rotation of the cable spools 12, 14, as well. Under these conditions, especially as the spools begin to empty, there is a less full contact between the spools and the cradle 24, and as a result, less friction. Because of the lesser friction, the wire can be fed from the spools with somewhat less effort.

In addition, wire from the spools 12, 14, can be more easily dispensed from the carrier 10 by virtue of the ability of the cradle 24 to rotate relative to the end walls 26 and 28. This rotation occurs by movement of the cradle 24 within the C-shaped channels 30 and 32. This easier dispensing occurs because the rotation of the cradle 24 causes the slots to rotate, as well. These slots tend to rotate to a position adjacent the precise point on the cable spool 12, 14, where the wire is being dispensed. Accordingly, there is a lesser tendency for kinking of the wire as it is being discharged from the spools 12, 14, and through the corresponding slots.

When the user either releases or stops pulling upon the wire, the cradle 24 returns from the position of FIG. 4 to the position shown in FIG. 1, and the periphery of the spools 12, 14, reassumes more fall contact with that cradle 24. Under these conditions, any spinning of the spools stops, and the potential for "free-wheeling" is eliminated.

The carrier 10 enables one to remove an individual spool when no wire remains on that spool, without disturbing the remaining spools. To remove an individual spool, such as 14, without disturbing the remaining spool 12, at least one of the two cotter pins 22 is removed from the central rod 20 of the carrier 10, while that carrier 10 is in the rest position of FIG. 1. Because the carrier 10 is in the rest position, the weight of the spools is supported by the cradle 24. The central rod 20 may therefore be removed from the carrier 10, so that that rod 20 is also removed from the centers of the spools 12, 14. Empty spool 14 may then be removed by lifting it upwardly and away from the cradle 24, and replaced with a full spool. The central rod 20 and cotter pins 22 are replaced, and the carrier 10 is ready for continued use.

To ensure that each spool remains adjacent its respective slot, it is preferred that spools, even when empty, remain on the carrier 10. The presence of closely adjacent spools prevents each spool from straying away from its intended slot.

As may be seen in FIGS. 1–4, the carrier 10 includes pegs 52 and hollows 54. These pegs 52 are interengageable with the hollows 54 of a second carrier when one carrier is stacked upon another, as may be seen in FIG. 3. This interengagement, in turn, stabilizes the stacked carriers.

Figure 3:
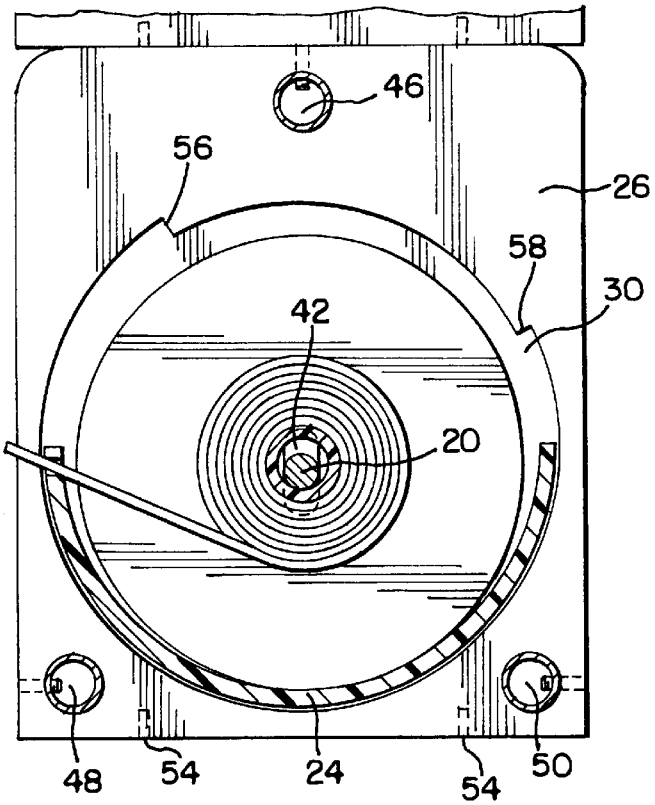
FIG. 3 is an inner end view of one of the ends walls of the wire spool carrier of the invention, taken along lines 3—3 of FIG. 2, with the wire spool in its general lower rest position.

Finally, as may best be seen for cut-out 30 in FIGS. 1, 3, and 4, in order to limit the rotation of the cradle 24, stops 56 and 58 are provided at approximately the 11:00 o'clock and 2:00 o'clock positions in the C-shaped channels 30 and 32, respectively. In effect, these stops 56 and 58 are the ends of each of the C-shaped channels.

Accordingly, the carrier of the invention provides a portable means of dispensing one or more strands of wire from one or more cable spools. The invention also provides a simplified structure for dispensing wire, and preventing uncontrolled feeding of wire as a result of free spinning of the wire spools. The present carrier also prevents the tangling or kinking of wire or cable as it is being dispensed.

While specific embodiments have been illustrated and described, numerous modifications come to mind without significantly departing from the spirit of the invention. Accordingly, the scope of protection is only intended to be limited by the scope of the accompanying claims.

What I claim is:

1. A carrier of one or more wire spools, said carrier being for the dispensing of wire from said wire spools, said carrier comprising:

(a) a central rod through which said wire spools are inserted;

(b) a cradle positioned below said wire spools, said cradle including one or more slots for passage of said wire through said slots;

(c) a pair of end walls for supporting said cradle; and (d) channels in said end walls for permitting rotation of said cradle relative to said end walls.

2. The carrier of claim 1, wherein said channels are formed by a cut-out in each of said end walls.

3. The carrier of claim 1, wherein said end walls include an orifice for the support of said central rod.

4. The carrier of claim 3, wherein said orifice in said end wall is of a non-circular configuration.

5. The carrier of claim 4, wherein said orifice in said end wall is of a generally oval configuration.

6. The carrier of claim 1, wherein said channels are generally C-shaped.

7. A carrier of one or more wire spools, said carrier being for the dispensing of wire from said wire spools, said carrier comprising:

(a) a central rod through which said wire spools are inserted;

(b) a generally semi-circular cradle positioned below said wire spools;

(c) one or more slots in said cradle for passage of said wire through said slots;

(d) a pair of end walls for supporting said semi-circular cradle; and (e) channels in said end walls formed by a generally circular cut-out in each of said end walls for permitting rotation of said cradle relative to said end walls; and (f) an orifice in each of said end walls for the support of said central rod.

8. The carrier of claim 7, wherein said orifice in each of said end walls is of a non-circular configuration.

9. The carrier of claim 7, wherein said orifice in each of said end walls is of a generally oval configuration.

10. The carrier of claim 7, wherein said central rod has a solid cross-section.

11. The carrier of claim 7, wherein said channels are generally C-shaped.

* * * * *